US009048032B2

(12) United States Patent
Galea

(10) Patent No.: US 9,048,032 B2
(45) Date of Patent: Jun. 2, 2015

(54) ELECTRICAL SWITCHING DEVICE

(71) Applicant: Methode Electronics Malta Ltd., Birkirkara (MT)

(72) Inventor: Alexander Galea, Dingli (MT)

(73) Assignee: Methode Electronics Malta Ltd., Birkirkara (MT)

( * ) Notice: Subject to any disclaimer, the term of this patent is extended or adjusted under 35 U.S.C. 154(b) by 216 days.

(21) Appl. No.: 13/710,835

(22) Filed: Dec. 11, 2012

(65) Prior Publication Data

US 2013/0146432 A1 Jun. 13, 2013

(30) Foreign Application Priority Data

Dec. 13, 2011 (DE) ..... 10 2011 056 333

(51) Int. Cl.

| | |
|---|---|
| ***H01H 13/18*** | (2006.01) |
| ***H01H 5/06*** | (2006.01) |
| ***H01H 13/48*** | (2006.01) |
| ***H01H 13/52*** | (2006.01) |
| *H01H 1/44* | (2006.01) |
| *H01H 5/30* | (2006.01) |

(52) U.S. Cl.

CPC . *H01H 5/06* (2013.01); *H01H 1/44* (2013.01); *H01H 5/30* (2013.01); *H01H 13/48* (2013.01); *H01H 13/52* (2013.01)

(58) Field of Classification Search

USPC ..... 200/468, 540–542

See application file for complete search history.

(56) References Cited

U.S. PATENT DOCUMENTS

| | | | | |
|---|---|---|---|---|
| 4,016,388 | A * | 4/1977 | Golbeck et al. | 200/314 |
| 4,092,503 | A * | 5/1978 | Raeder | 200/5 A |
| 4,169,974 | A * | 10/1979 | Peers-Trevarton | 200/276 |
| 4,434,338 | A * | 2/1984 | Rood | 200/276 |
| 5,523,684 | A | 6/1996 | Zimmermann | |
| 5,870,013 | A * | 2/1999 | Van Der Grijn et al. | 337/343 |
| 2010/0236912 | A1 * | 9/2010 | Anaya | 200/468 |
| 2011/0147186 | A1 * | 6/2011 | Mori et al. | 200/468 |
| 2013/0048483 | A1 * | 2/2013 | Speldrich et al. | 200/468 |

FOREIGN PATENT DOCUMENTS

DE 102009035175 A1 2/2010

OTHER PUBLICATIONS

U.S. Appl. No. 13/710,835, filed Dec. 11, 2012.

* cited by examiner

*Primary Examiner* — Renee Luebke
*Assistant Examiner* — Ahmed Saeed
(74) *Attorney, Agent, or Firm* — Thompson Coburn LLP

(57) ABSTRACT

An electrical switch device has a contact system and a movable actuator for switching the contact system. The contact system resiliently preloads a sliding contact against a first fixed contact in a first switch position and against a second fixed contact in a second switch position. In case of pressurization, the actuator moves the sliding contact mainly linearly from the first switch position to the second switch position. In the first switch position, the actuator adjoins to a snap-action element having a stable position and actuates the latter from its stable position to an instable position when switching over to the second switch position, wherein the snap-action element returns to the stable position upon completion of pressurization by means of the actuator.

10 Claims, 2 Drawing Sheets

ELECTRICAL SWITCHING DEVICE

CROSS-REFERENCE RELATED APPLICATIONS

This application claims priority to German patent Application No. 10 2011 056 333.4, filed Dec. 13, 2011, the disclosure of which is incorporated by reference herein.

BACKGROUND AND SUMMARY

The present invention relates to an electrical switch device.

Such a switch device results, for example, from DE 10 2007 040 714 A1. This known switch device covers a contact system comprising a movable switch contact and two fixed contacts. The switch device furthermore has a movable actuator for switching the contact system. When switching the contact system, the movable switch contact is movable such that it adjoins to a first fixed contact in a first switch position and to the second fixed contact in a second switch position.

The switch contact has the shape of a slider, and the fixed contacts are designed as contact surfaces such that the slider interacts with the contact surfaces upon switching. In addition, a leaf spring is provided which is coupled with the slider and interacts with the actuator for resetting.

Such switch devices which are designed as micro switch devices or snap-action switch devices are used for the switching of power currents or signal currents, for example in motor vehicles.

The technical problem of the present invention is to develop such an electrical switch device in such a manner that its switch contacts have precisely predefined switch positions upon switching in the switch positions of the contact system.

This technical problem is solved by means of an electrical switch device comprising the features of patent claim 1.

The essential advantage of the present invention is that the present electrical switch device ensures precisely predefined switch positions upon switching due to its specific configuration comprising a so-called snap-action element. Switching errors are thus avoided. Due to the combination with said snap-action element, it is ensured that during the switching operation, on the one hand, the switching power is at first transmitted smoothly and resiliently from the actuator to the switching system, and, on the other hand, the switch positions of the sliding contact are subsequently reached and/or adjusted precisely. In this respect, it must be made sure that the sliding contacts always resiliently adjoin to the fixed contacts.

Another essential advantage of the switch device according to the invention is that the actuator is moved linearly, which is why the overall switch device operates precisely and can be constructed in a less bulky and more space-saving manner.

The electrical switch device according to the invention comprises a contact system having at least one movable sliding contact and at least one first fixed contact as well as a second fixed contact. In addition, the switch device according to the invention comprises a movable actuator for switching the contact system, wherein, when switching the contact system, the switch contact is movable such that it adjoins to the first fixed contact in a first switch position and to the second fixed contact in a second switch position. The contact system resiliently preloads the sliding contact against the first fixed contact in the first switch position and against the second fixed contact in the second switch position. In case of pressurization, the actuator moves the sliding contact mainly linearly from the first switch position to the second switch position. In the first switch position, the actuator adjoins to a snap-action element having a stable position and actuates the latter from its stable position to an instable position when switching over to the second switch position, wherein the snap-action element returns to the stable position upon completion of pressurization by means of the actuator.

In a preferred, constructively simple and effective embodiment of the invention, the actuator has a spring part at the one end of which the sliding contact is arranged, wherein the other end of the spring part is fixed to a pencil-shaped part mounted in the disk element on one side of a disk element, and wherein an area of said pencil-shaped part protruding beyond the disk element on the other side of the disk element forms a connecting part.

In an advantageous further embodiment of the invention, opposite to the pencil-shaped part, a further pencil-shaped part, at the one end of which a further sliding contact is arranged, is provided on the disk element. The other end of the further spring part is fixed on one side of the disk element to a further pencil-shaped part mounted in the disk element, wherein an area of the pencil-shaped part protruding beyond the disk element on the other side of the disk element forms a further connecting part.

In an advantageous further embodiment of the invention, the other ends of the rod-shaped spring part and the further rod-shaped spring part can be connected to each other by means of a rod-shaped part. In this way, the sliding contact, the spring part, the rod-shaped part, the further spring part and the further sliding contact can be formed as a single piece, in particular of an electrically conductive metal spring wire part.

The spring part and/or the further spring part can be attached to the corresponding pencil-shaped parts in a particularly simple and effective manner by winding or bending their other end portions round the corresponding pencil-shaped parts in each case. At the same time, the electrical contacts are established between the spring parts and the pencil-shaped parts.

Preferably, the actuator has the shape of a block which is expediently made of a plastic material and which, on the side facing the disk element, has a peg-shaped area adjoining to the snap-action element. A pressure spring is provided preloading the actuator towards the snap-action element. The rod-shaped spring part is attached to one side of the actuator. If the further spring part is also provided, the latter is attached to the side of the actuator opposite to the one side of the actuator. It is thus achieved that the block-shaped actuator is surrounded in a frame-like manner by the spring parts and held between the latter. Upon actuation of the actuator, the sliding contacts moulded onto the spring parts advantageously perform a mainly linear movement.

Preferably, the pressure spring is arranged in a receiving space of the actuator, with one end of the pressure spring resting on the bottom of the receiving space and the other end of the pressure spring resting on a tappet element held in the case of the switch device and protruding outwards through an opening of an upper case part of the case of the switch device for actuation. In a further embodiment of the invention, the other end of the pressure spring presses against a flange part of the tappet element, which can be pressed against the rim of the recess due to the force of the pressure spring. Advantageously, it is thus achieved that the force acting on the tappet element is transmitted smoothly and in a well-defined manner via the peg-shaped element to the snap-action element.

Advantageously, the snap-action element is arranged and/or attached to the disk element above a recess, with the snap-action element being capable of partly engaging with the recess in the instable position. This enables a simple movement of the snap-action element between its stable and instable position.

DESCRIPTION OF THE DRAWINGS

The invention and its embodiments are explained in greater detail below with reference to the figures, in which.

DETAILED DESCRIPTION

Figure 2:
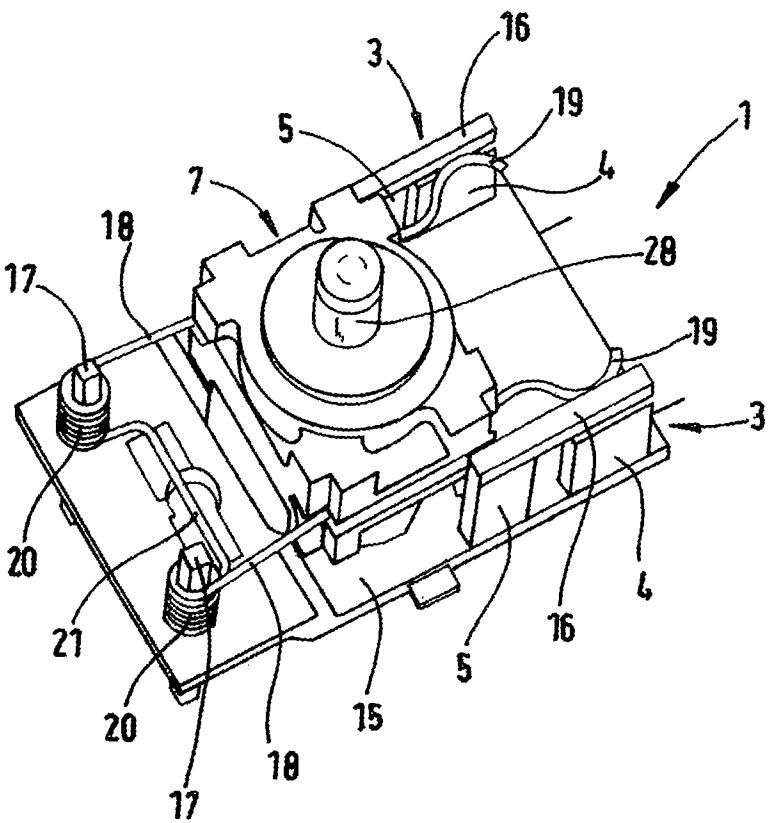
FIG. 2 shows a semiplan view of the switch device of FIG. 1.
Figure 1:
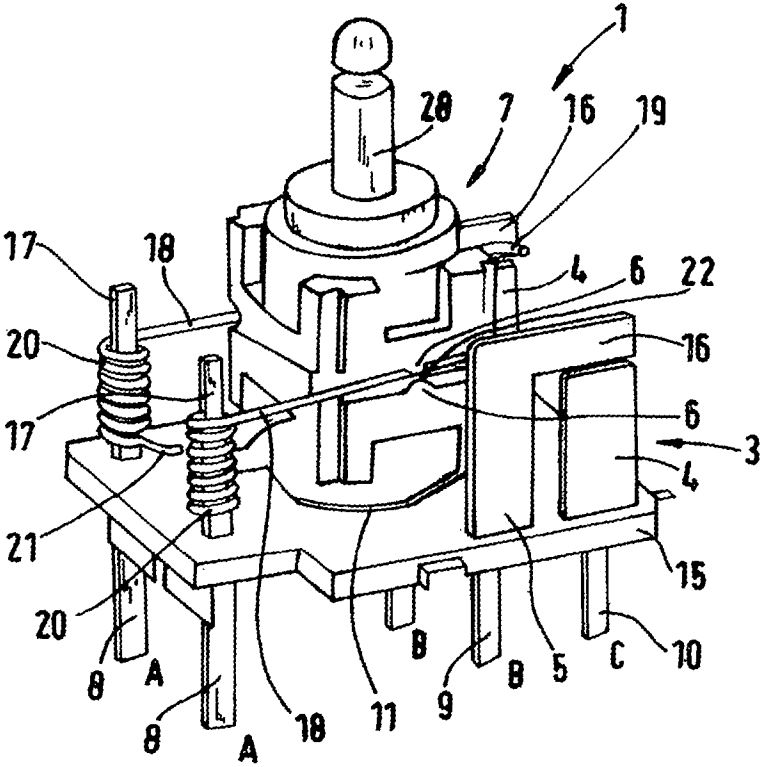
FIG. 1 shows a schematic and three-dimensional view of the assembly of the switch device according to the invention.
Figure 3:
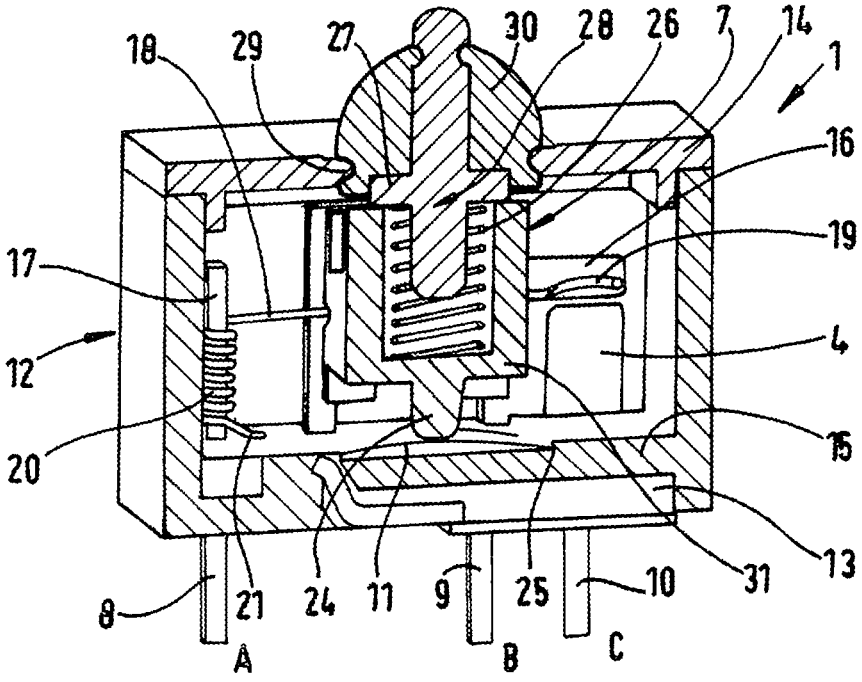
FIG. 3 shows a cross-section through the switch device of FIGS. 1 and 2 showing the case surrounding the switch device, which is not illustrated in FIGS. 1 and 2 for the sake of simplicity.

According to FIGS. 1 to 3, the present electrical switch device 1 substantially comprises an actuator 7, a contact system 3 with fixed contacts 4, 5 and sliding contacts 19, connecting parts 8, 9 and 10 and a so-called snap-action element 11. The snap-action element has the shape of a sheet metal part, which is preferably designed as a circular disk and which is movable under load in its centre between a stable upper position, which is, in particular, shown in FIG. 3, and an instable lower position (not illustrated in the figures).

The aforementioned elements are arranged in a case 12 comprising a bottom case part 13 as well as a cover-shaped upper case part 14.

The fixed contacts 4 and 5 are arranged in a disk element 15, which may preferably be a part of the bottom case part 13, wherein said fixed contacts 4 and 5 protrude outwards with one portion respectively beyond the disk element 15 from the case 12 as connecting parts 9 and 10. Preferably, two fixed contacts 4, 5 and connecting parts 9 and 10 are respectively arranged on sides of the disk element 15 opposite to each other in the cross direction, wherein the fixed contact 4 linearly extends upwardly from the disk element 15, and the other fixed contact 5 being arranged on the side adjacent to the fixed contact 4 extends at first also linearly in an upward direction from the disk element 15 and comprises an angled upper portion 16 spanning the fixed contact 4, but being spaced from the latter. The fixed contacts 4 and 5 are preferably arranged on the same plane running perpendicularly to the disk element 15.

Furthermore, at least one pencil-shaped part 17 protruding outwards beyond the disk element 15 from the case 12 in the shape of a connecting part 8 is mounted in the disk element 15. Preferably, two such pencil-shaped parts 17 are provided opposite to each other. On each side of the disk element 15 opposite to each other in the cross direction of the disk element 15, two fixed contacts 4, 5 as well as the corresponding connecting parts 9, 10 and, spaced therefrom along said side in the longitudinal direction of the disk element 15, a pencil-shaped part 17 as well as the corresponding connecting part 8 are provided respectively.

To each pencil-shaped part 17, a rod-shaped spring part 18 running in the longitudinal direction is attached, at the free end of which, opposite to the pencil-shaped part 17, a sliding contact 19 is provided being capable of contacting the fixed contact 4 as well as the area 16 of the fixed contact 5 arranged above. The sliding contacts 19 each being resiliently preloaded to the outside resiliently adjoin to the fixed contacts 4, 5 respectively.

Preferably, such a rod-shaped spring part 18 is attached to each pencil-shaped part 17, wherein the attachment of the rod-shaped spring parts 18 to the pencil-shaped parts 17 is, in particular, implemented such that the end portions of the spring parts 18 facing away from the sliding contacts 19 are tightly wound and/or bent round the pencil-shaped parts 17. In the figures, the winding areas of said end portions of the spring parts 18 are identified by reference numeral 20. In order to be able to establish a simultaneous electrical connection between the connecting parts 8 on each side of the disk element 15 and the corresponding fixed contacts 4, 5, the free end portions of the winding areas 20 are preferably electrically connected to each other by means of a rod-shaped spring part 21 running in the cross direction. Expediently, the sliding contacts 19, the rod-shaped spring parts 18, the winding areas 20 as well as the rod-shaped spring part 18 are formed as a single piece of an electrically conductive metal spring wire part, wherein the sliding contacts 19 at the free ends of the rod-shaped spring parts 18 have the shape of areas running in a curve from the rod-shaped spring parts 18 in the outward direction to the corresponding fixed contacts 9 and 10.

In order to actuate the sliding contacts 19, the aforementioned actuator 7, which is linearly movable perpendicularly to the disk element 15 and to which the rod-shaped spring parts 18 are attached on opposite sides, is provided between the rod-shaped spring parts 18 spaced from each other in the cross direction. Preferably, the rod-shaped spring parts 18 each run through a groove 22 expediently formed between the projections 6 in the side panels opposite to each another, wherein the projections 6 are spaced from each other along a line running perpendicularly to the disk element 15.

According to the form represented, the actuator 7 has the shape of a block which is held in the case 12, movable perpendicularly to the disk element 15 and expediently made of a plastic material and in the interior of which, according to FIG. 3, a receiving space 23 is formed, the function of which will be explained in greater detail below. On its side facing the disk element 15, the actuator 7 has a peg-shaped area 24 protruding in the direction of the disk element 15 and centrically adjoining to the snap-action element 11, which is preferably designed as a circular disk and provided at the disk element 15. The snap-action element 11 is attached to the disk element 15 in such a manner that, as shown in FIG. 3, it has a stable upper position, in which it preloads the peg-shaped area 24 as well as the actuator 7 upwardly from the disk element 15. In the event that the actuator 7 is moved correspondingly, the peg-shaped element 24 can pressurize the snap-action element 11 such that it is abruptly movable from said stable upper position to an instable lower position. For this purpose, the disk element 15 preferably has a trench-shaped recess 25 which can receive the middle portion of the snap-action element 11 in said second position. Due to the fact that the actuator 7 is held between the rod-shaped spring parts 18, which resiliently rest on the fixed contacts 4, 5 by means of the sliding contacts 19, it is preferably ensured that the peg-shaped area 24 of the snap-action element 11 is always precisely centred and positioned above the snap-action element 11. During the single switching operations, a constant switching function is thus performed between the two aforementioned positions, wherein the sliding contacts 19 of the spring parts 18 connected to the actuator 7 always precisely adjoin to predefined contact points of the fixed contacts 4, 5 in said positions of the snap-action element 11.

In the aforementioned receiving space 23 of the actuator 7, a pressure spring 26 is provided, the one end of which preferably rests on the bottom 31 of the receiving space 23 of the actuator 7 facing the snap-action element 11, and the other end of which adjoins to a flange part 27 of a tappet element 28 arranged on the side of the actuator 7 facing away from the snap-action element 11. The tappet element 28 protrudes with its end portion facing away from the flange part 27 through an opening 29 of the upper case part 14 to the outside.

In order to seal said opening 29, a cushion-type sealing element 30 is provided, which, on the one hand, is tightly fixed to the upper case part 14 and, on the other hand, to the tappet element 28.

The function of the present switch device 1 will be explained in greater detail below, wherein reference is made, in particular, to FIG. 3, which shows the switch device 1 in its non-operating state.

In the event that the end of the tappet element 28 protruding from the case 12 is pressed against in order to actuate the switch device 1, the tappet element 28 moves downwardly against the force of the pressure spring 26 until the flange part 27 adjoins to the upper rim of the receiving space 23 of the actuator 7. This means that the force acting on the tappet element 28 is transmitted smoothly and in a well-defined manner to the actuator 7 and hence simultaneously via the peg-shaped element 24 to the snap-action element 11 being arranged in its stable position. Only after the snap-action element 11 has abruptly snapped from its stable upper position in its instable lower position upon further exertion of force, the actuator 7 is moved together with the spring parts 18 mechanically linked therewith such that the sliding contacts 19 move from the contact points of the portions 16 of the fixed contacts 5 associated to the stable position to the contact points of the fixed contacts 4. At the same time, the location of the corresponding contact points is determined by the positions of the snap-action element 11. In the stable (upper) position of the snap-action element 11, the electrical connections A-B, A-B, and in the instable (lower) position of the snap-action element 11, the electrical connections A-C, A-C according to FIG. 1 are established. Upon release of the tappet element 28, the snap-action element 11 snaps back in its stable (upper) position so that the connections A-B, A-B are re-established.

REFERENCE NUMERALS

1 electrical switch device
3 contact system
4 fixed contact
5 fixed contact
6 projection
7 actuator
8 connecting part
9 connecting part
10 connecting part
11 snap-action element
12 case
13 lower case part
14 upper case part
15 disk element
16 portion
17 pencil-shaped part
18 rod-shaped spring part
19 sliding contact
20 winding area
21 rod-shaped spring part
22 groove
23 receiving space
24 peg-shaped area
25 recess
26 pressure spring
27 flange part
28 tappet element
29 opening
30 seal
31 bottom

What is claimed is:

1. An electrical switch device with a contact system (3) comprising at least one movable sliding contact (19) and at least one first fixed contact (4) and a second fixed contact (5) as well as a movable actuator (7) for switching the contact system (3), wherein the sliding contact (19) is movable during the switching of the contact system (3) such that it adjoins to the first fixed contact (4) in a first switch position and to the second fixed contact (5) in a second switch position, wherein the contact system (3) resiliently preloads the sliding contact (19) against the first fixed contact (4) in the first switch position and against the second fixed contact (5) in the second switch position, wherein the actuator (7) moves the sliding contact (19) mainly linearly from the first switch position to the second switch position in case of pressurization, wherein in the first switch position, the actuator (7) adjoins to a snap-action element (11) having a stable position and actuates the latter from its stable position to an unstable position when switching over to the second switch position, wherein the snap-action element (11) returns to the stable position upon completion of pressurization by means of the actuator (7), wherein the contact system (3) has a spring part (18) with first and second ends, the spring part first end is arranged at the sliding contact (19), the spring part second end is fixed to a post-shaped part (17), wherein the post-shaped part is mounted in a base element (15) and extends from one side of the base element (15) to enable the spring part second end to be fixed thereto, and wherein the post-shaped part (17) forms a connecting part (8) extending from the base element (15) on an opposite side of the base element (15).

2. A switch device according to claim 1, characterised in that, on the base element (15) opposite to the post-shaped part (17) in a cross direction of the base element (15), a further post-shaped part (17) is arranged, and opposite to the sliding contact (19) in the cross direction of the base element (15), a further sliding contact (19) is provided, and a further spring part (18) with first and second ends is provided, the further spring part (18) first end is at the further sliding contact (19), the further spring part (18) is fixed to the further post-shaped part (17), the further post-shaped part is mounted in the base element (15) wherein the further post-shaped part (17) extends from the one side of the base element (15) and forms a further connector part (8) protruding beyond the base element (15) on the opposite side of the base element (15).

3. A switch device according to claim 2, characterised in that the second ends of the spring part (18) and the further spring part (18) are connected to each other by means of a rod-shaped part (21) preferably running in the cross direction of the base element (15).

4. A switch device according to claim 3, characterised in that the sliding contact (19), the spring part (18), the rod-shaped part (21), the further spring part (18) and the further sliding contact (19) are formed as a single piece of an electrically conductive metal spring wire.

5. A switch device according to claim 2, characterised in that the second ends of at least one of the spring part (18) and the further spring part (18) are fixed to the respective post shaped part (17) by winding or bending.

6. A switch device according to claim 1, characterised in that the actuator (7) has a block-shape which is linearly movable perpendicularly to the base element (15) and which, on its side facing the disk element (15), has a peg-shaped area (24) adjoining to the snap-action element (11), characterised in that a pressure spring (26) is provided preloading the actuator (7) towards the snap-action element (11), and characterised in that the spring part (18) is attached to one side of the actuator (7).

7. A switch device according to claim 6, characterised in that the further spring part (18) is attached to a side of the actuator (7) opposite to the one side of the actuator (7) in the cross direction.

8. A switch device according to claim 6, characterised in that the pressure spring (26) is arranged in a receiving space (23) of the actuator (7), wherein one end of the pressure spring (26) rests on a bottom of the receiving space (23) and another end of the pressure spring (26) rests on a tappet element (28) protruding outwards through an opening (29) of an upper case part (14) of the case (12) of the switch device for actuation.

9. A switch device according to claim 8, characterised in that the other end of the pressure spring (26) presses against a flange part (27) of the tappet element (28).

10. A switch device according to claim 1, characterised in that the snap-action element (11) is arranged on the base element (15) above a recess (25), wherein it partly engages with the recess (25) in the unstable position.

* * * * *